US009771739B1

(12) United States Patent
Wells

(10) Patent No.: US 9,771,739 B1
(45) Date of Patent: Sep. 26, 2017

(54) THREE PIECE KEY ASSEMBLY

(71) Applicant: Charmaine Marie Wells, Irvine, CA (US)

(72) Inventor: Charmaine Marie Wells, Irvine, CA (US)

( * ) Notice: Subject to any disclaimer, the term of this patent is extended or adjusted under 35 U.S.C. 154(b) by 0 days.

(21) Appl. No.: 15/150,396

(22) Filed: May 9, 2016

(51) Int. Cl.
*E05B 19/04* (2006.01)
*E05B 19/10* (2006.01)

(52) U.S. Cl.
CPC ..... *E05B 19/04* (2013.01); *Y10T 70/7802* (2015.04); *Y10T 70/7876* (2015.04)

(58) Field of Classification Search
CPC ..... E05B 19/04; E05B 19/24; Y10T 70/7876; Y10T 70/7802; Y10T 70/8676; Y10T 70/8811
USPC ..... 70/278.3, 395, 408, 456 R, 460; 24/3.6; 40/330, 634
See application file for complete search history.

(56) References Cited

U.S. PATENT DOCUMENTS 1,032,930 A * 7/1912 Moseley ..... E05B 19/24 40/330
1,438,839 A * 12/1922 Levey ..... E05B 17/106 250/465.1
2,653,492 A * 9/1953 Abrams ..... B23K 20/22 70/408
3,729,965 A * 5/1973 Gartner ..... E05B 19/04 70/395
3,950,973 A * 4/1976 Grasnianski ..... B21D 53/42 70/395
4,349,975 A * 9/1982 Chubb ..... E05B 19/24 40/330
4,417,410 A * 11/1983 Freedom ..... G09F 3/04 40/330
4,991,417 A * 2/1991 Grecco ..... E05B 19/00 294/158
5,038,590 A * 8/1991 Sawyer ..... E05B 19/04 70/408
5,383,345 A * 1/1995 Kallinger-Prskawetz-Jacobsen E05B 19/04 403/294
5,768,925 A * 6/1998 Ozawa ..... E05B 19/04 70/278.2
5,819,564 A * 10/1998 Watanuki ..... G07C 9/00944 70/278.2
5,832,761 A * 11/1998 Chen ..... E05B 19/00 70/395
5,974,844 A * 11/1999 Harrelson ..... E05B 19/04 70/278.2
6,016,676 A * 1/2000 McConnell ..... A44B 15/005 70/395

(Continued)

FOREIGN PATENT DOCUMENTS

EP 1350910 * 10/2003
JP 11315652 * 11/1999

*Primary Examiner* — Lloyd Gall

(57) ABSTRACT

A lock key comprising of (3) pieces. A head, a key blade and a snap lock. These pieces are interlocked together, so that separation is not possible in normal usage. The head is made of precious metal or non precious metal set with or without stones and may consist of various esthetic and ornamental forms. The snap lock engages the head and the key blade in a way to inhibit the removal of the head from the key blade in normal use. The key blade can be easily removed from the head and exchanged with another key blade as needed.

3 Claims, 4 Drawing Sheets

(56) References Cited

U.S. PATENT DOCUMENTS

| | | | | |
|---|---|---|---|---|
| 6,427,504 | B1 * | 8/2002 | Janssen | E05B 19/04 70/278.3 |
| 2003/0074938 | A1 * | 4/2003 | Seki | E05B 19/04 70/408 |
| 2004/0148988 | A1 * | 8/2004 | Taylor | E05B 19/04 70/408 |
| 2005/0217327 | A1 * | 10/2005 | Frias Frias | E05B 19/04 70/395 |
| 2005/0229662 | A1 * | 10/2005 | Banks | E05B 19/04 70/278.3 |
| 2005/0241353 | A1 * | 11/2005 | Moening | E05B 19/04 70/408 |
| 2006/0090528 | A1 * | 5/2006 | Moening | E05B 19/04 70/395 |
| 2007/0006621 | A1 * | 1/2007 | Doong | E05B 19/04 70/409 |
| 2008/0163656 | A1 * | 7/2008 | Chang | E05B 19/24 70/408 |

* cited by examiner

THREE PIECE KEY ASSEMBLY

FEDERALLY SPONSORED RESEARCH

Not applicable

SEQUENCE LISTING OR PROGRAM

Not applicable

BACKGROUND OF THE INVENTION

Field of Invention

Lock key assembly made of 3 interlocking pieces

Prior Art

The inventor is aware of previous patents and claims of a general type of different key mechanism. US patent 2005/0217327 to Antonio Frias shows two open projections of the key blade which surrounds a semi circle and creates a semi hole. This hole extends also to the key head. A locking pin is seated in this hole with no means of arresting mechanically the axial movement of this locking pin. US patent 2004/0148988 Mark Raymond Taylor shows no mechanical means of locking the key blade to the key head. It describes it to be "reasonably held" by friction, glue, epoxy or welding. U.S. Pat. No. 3,950,973 Serge Graniansky describes a key with a male protrusion a key holder with an equivalent female cut out, to accommodate said male protrusion. This sub assembly has to be assembled first. The key holder has a slight angle on its side edges, corresponding to the slight angle in the slot of the key head. The sub assembly is pushed into the key head to be held in place by forced wedging action. There is no means of a positive mechanical locking action.

BACKGROUND OF THE INVENTION OBJECTS AND ADVANTAGES

This invention has a positive mechanical locking action. The locking mechanism is straight forward applying a simple push to the snap lock, and the assembly is positively mechanically locked. There is no wedging, glue, friction, welding or screw tightening in this invention. The inventor wants to point out the special design of the locking mechanism of this invention. The design is simple, and easy to manufacture. Lock smiths and key cutters have no problem handling the key cutting and the assembly. An angled notch is provided on one side of the snap lock flange in order to release the key assembly to disengage as needed.

DRAWING FIGURES

DETAILED DESCRIPTION—FIGS.

Figure 1:
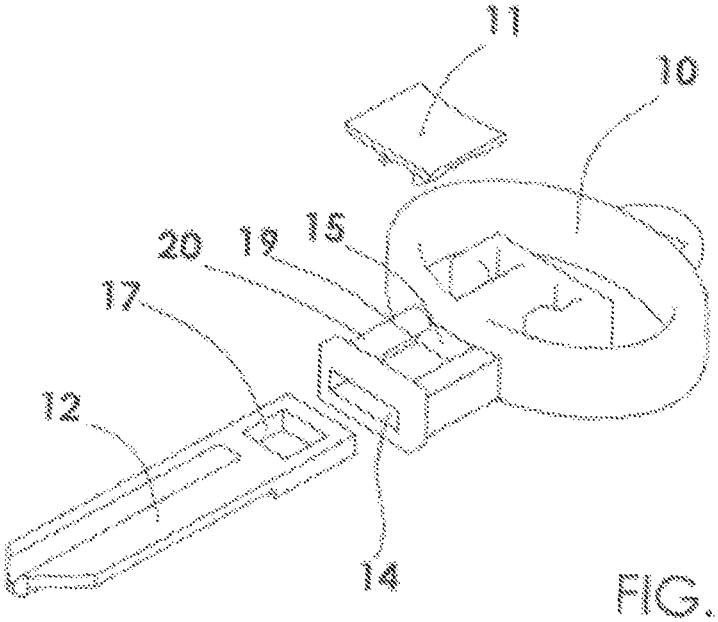
FIG. 1 Shows an exploded view of the Three Part Assembly
Figure 2:
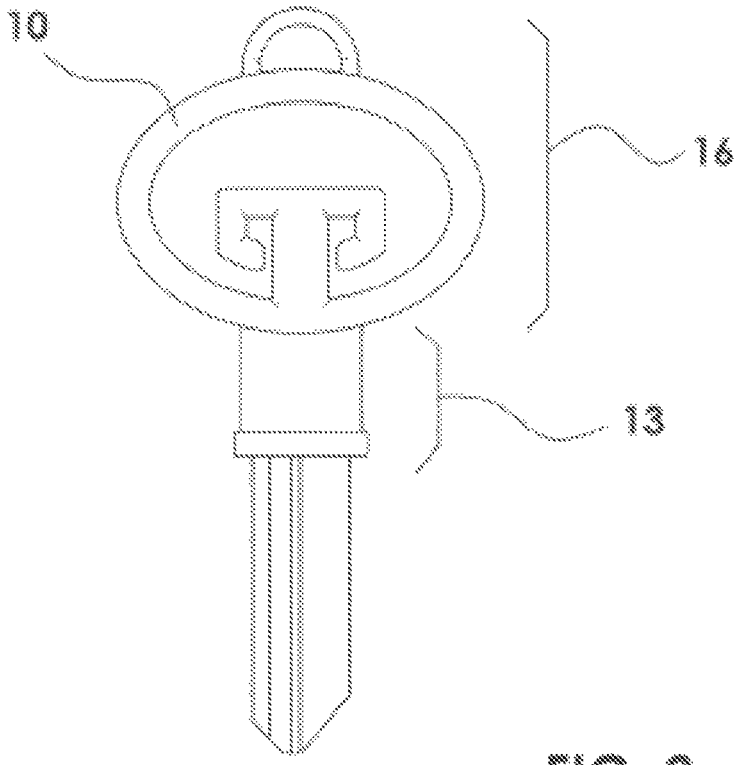
FIG. 2 Shows the front view of the key assembly
Figure 3:
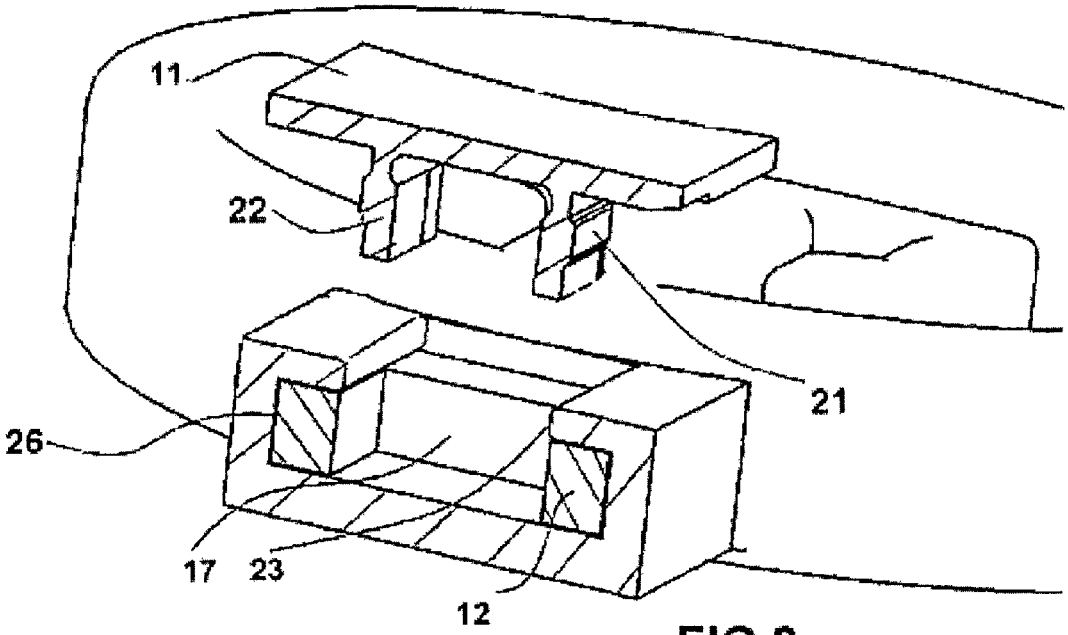
FIG. 3 Shows a cross-section of the assembly before locking in with the Snap-lock FIG. 4 Shows a cross-section of the assembly after inserting the snap-lock
Figure 4:
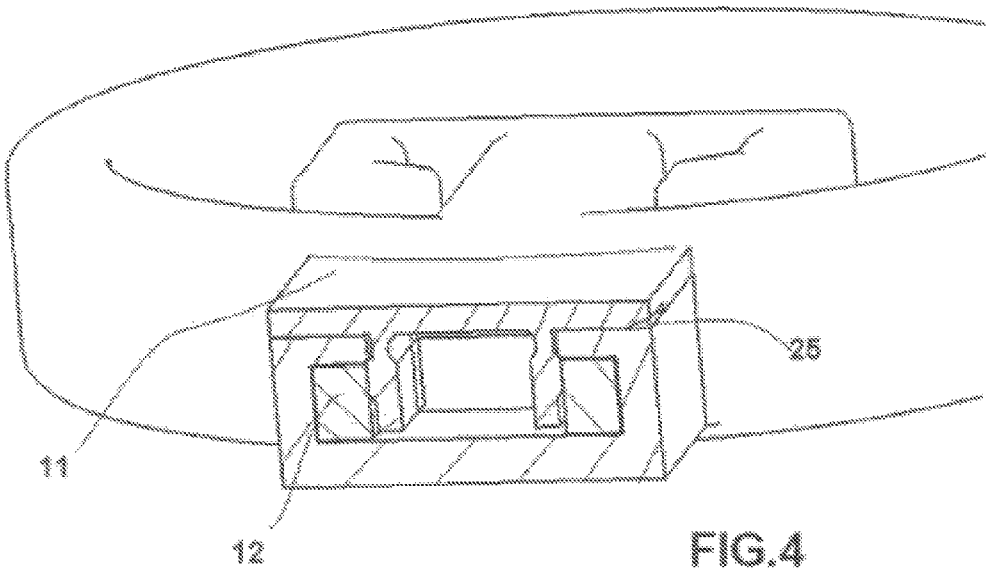

A key assembly consisting of a head 10 FIG. 1, a snap-lock 11 FIG. 1, and a key blade 12 FIG. 1. The head 10 having a casing area on it's one end 13 FIG. 2, and a ornamental area 16 FIG. 2. The ornamental area 16 might change in style for artistic purposes. The casing area 13 will be in design always the same. The casing area 13 has a slot on it's distal end 14 FIG. 1 to receive the key blade 12. The slot having a stop on its end 15 FIG. 1 and tight slide fits on the sides 26 FIG. 3 to make a tight engagement with the key blade 12. The key blade having a square opening 17 FIG. 1. The casing area having a square opening 19 on the top surface 20 FIG. 1 to facilitate entry of the snap-lock 11. The snap-lock having two springy arms 22 FIG. 3 with protrusions 21 FIG. 3 to slide and bend inwards and slide over the dead point 23 FIG. 3 of the casing area of the head, and to snap back after passing the dead point of the casing area 23 FIG. 3 and positioning itself into the square hole 17 FIG. 3 of the key blade 12 FIG. 3, having a tight fit with the hole of the key blade and positively locking the key blade 12 into position. In addition the snap-lock has on its side on the lower part of its flange an angled notch 25 FIG. 4 which exist to insert a small sharp tool to release the snap lock from the head and to disengage the key blade from the casing.

Operation:

In order to assemble these three parts into a key assembly the key blade 12 FIG. 1 is inserted into the slot 14 of the casing until it hits the end stop 15 of the head 10. The snap-lock 11 is than pushed from above into the square opening 19 of the casing where it will engage with a distinctive click and lock the key blade 12 into position being seated in the square opening 19 of the casing, and locking the key blade into position by engaging the square opening 17 FIG. 3 of the key blade. Although the key assembly is perfectly rigid it can be taken apart by means of an angled notch 25 FIG. 4. To disengage this assembly, a small sharp tool will be inserted into the angled notch 25 on the side of the snap-lock 11 and by doing a lever action with a small tool the snap-lock 11 will be disengaged from its locked position and the key assembly will be disassembled.

DRAWINGS Reference Numerals

Head 10
Snap-Lock 11
Key Blade 12
Casing area 13
Slot 14
Stop End 15
Ornamental Area 16
Key square opening 17
Head square opening 19
Top surface 20
Protrusions of Snap-Lock 21
Springy Arms 22
Dead point 23
Angled Slot 25
Slide Fits 26

I claim:

1. A key assembly comprising:

(a) a head having a front surface and a back surface and on one end of said head having an ornamental area and on the other end of said head having a casing area, said casing area has on its one surface a substantially square opening to accommodate a snap lock and on its distal end a slot to accommodate a key blade, said slot intersects perpendicularly with said substantially square opening;

(b) a key blade which has two flat sides and on its one end has a substantially square opening through the key blade to accommodate the snap lock;

(c) a snap lock which includes a flat platform with two springy arms vertically protruding from it, being parallel to each other, with convex protrusions on the outsides of said arms, said protrusions pointing outward from the center of the platform.

2. The key assembly of claim 1, wherein said snap lock has an angled notch on one side starting from an edge of said platform and being located on the same side of said platform were said arms are protruding.

3. The key assembly of claim 1, comprised of material including metal, precious metals or plastic.

* * * * *